US006091370A

United States Patent [19]

Shaffer

[11] Patent Number: 6,091,370

[45] Date of Patent: Jul. 18, 2000

[54] METHOD OF MAKING A MULTIPLE BAND ANTENNA AND AN ANTENNA MADE THEREBY

[75] Inventor: David Todd Shaffer, Mechanicsburg, Pa.

[73] Assignee: The Whitaker Corporation, Wilmington, Del.

[21] Appl. No.: 09/141,117

[22] Filed: Aug. 27, 1998

Related U.S. Application Data

[60] Provisional application No. 60/057,738, Aug. 28, 1997.

[51] Int. Cl.[7] ..... H01Q 1/00

[52] U.S. Cl. ..... 343/729; 343/742; 343/867; 29/600

[58] Field of Search ..... 343/700 MS, 725, 343/729, 722, 741, 742, 743, 744, 745, 749, 866, 867, 868, 895; 29/600, 827, 846

[56] References Cited

U.S. PATENT DOCUMENTS

| | | | |
|---|---|---|---|
| 3,747,112 | 7/1973 | Hidaka | 343/749 |
| 4,489,276 | 12/1984 | Yu | 324/338 |
| 5,255,005 | 10/1993 | Terret et al. | 343/895 |
| 5,359,340 | 10/1994 | Yokota | 343/792 |
| 5,649,350 | 7/1997 | Lampe et al. | 29/600 |
| 5,709,832 | 1/1998 | Hayes et al. | 364/272.11 |
| 5,724,717 | 3/1998 | Gherardini et al. | 29/600 |
| 5,771,023 | 6/1998 | Engblom | 343/702 |
| 5,841,407 | 11/1998 | Birnbaum | 343/895 |
| 5,909,196 | 6/1999 | O'Neill | 343/895 |

FOREIGN PATENT DOCUMENTS

| | | | |
|---|---|---|---|
| 0 772 255 A1 | 5/1997 | European Pat. Off. | H01Q 9/04 |
| WO 96/38882 | 12/1996 | WIPO | H01Q 9/30 |
| WO 98/48477 | 10/1998 | WIPO | H01Q 5/00 |

OTHER PUBLICATIONS

U.S. Ser. No. 09/062424, filed Apr. 17, 1998, (Abstract and dawings only).

U.S. Ser. No. 09/116,762, filed Jul. 16, 1998, (Abstract and drawings only).

*Primary Examiner*—Don Wong
*Assistant Examiner*—Tho Phan

[57] ABSTRACT

A continuous method of fabricating multiple band antennas having first and second conductive wire lengths that are partially overlapped a selected distance, at least one of the wire lengths being insulated, includes the steps of: severing a first end of at least one of the wire lengths from a second end of a preceding antenna; defining an overlap portion of the first conductive wire length coextending a selected distance along and adjacent an overlap portion of the second conductive wire length, defining an overlap; and severing the second end of at least one of the wire lengths from a first end of another of the one of the wire lengths after the overlap is defined. At least one of the conductive wire lengths is insulated. The overlap portions of the conductive wire lengths and the insulation therebetween comprise and define a mechanical and a reactive coupling.

25 Claims, 4 Drawing Sheets

METHOD OF MAKING A MULTIPLE BAND ANTENNA AND AN ANTENNA MADE THEREBY

This application claims benefit of provisional application Ser. No. 60/057,738 Aug. 28, 1997.

FIELD OF THE INVENTION

This invention is directed to antennas and more particularly to a multiple band antenna and a method of making a multiple band antenna.

BACKGROUND OF THE INVENTION

The cellular communications industry including cellular telephones, paging devices, and the like use a range of frequencies between 800 and 900 megahertz (MHz). Cellular telephones, pagers, and the like generally use a whip antenna that is tuned to provide optimum performance in the above frequency range. With the advent of personal communications services (PCS) for providing services such as data transmission, wireless voice mail, and the like, the FCC has established a center frequency of 1.9 gigahertz (GHz) with a suitable band width, well known to one skilled in the art. As the new PCS technology expands, there is a need to provide devices that can receive and transmit communications in both the 800–900 MHz and 1.92 GHz frequency ranges. Cellular telephones and the like, therefore, need to have antennas that will operate at each of the two frequency ranges. One way to achieve this is to provide two separate antennas. It is more desirable and economical, however, to provide a single antenna having at least dual band capability.

SUMMARY OF THE INVENTION

This invention is directed to a method of making a multiple band whip antenna and a multiple band antenna made thereby. The invention is further directed to a continuous method of fabricating multiple band antennas. For purposes of illustration the embodiment discussed is a dual band antenna. It is to be understood that the invention is not limited to dual band antennas. It is to be further understood that the term "frequency" as used herein includes a frequency range or band and is not limited to a single frequency. Each of the multiple band antennas have at least first and second conductive wire lengths that are only partially overlapped a selected distance with at least one of the wire lengths being insulated. The continuous method of fabricating the above antennas comprises the steps of:

severing a first end of at least one of the first and second conductive wire lengths from a second end of a preceding antenna; defining an overlap portion of the first conductive wire length coextending a selected distance along and adjacent an overlap portion of the second conductive wire length comprising an overlap; and severing the second end of at least one of the first and second conductive wire lengths from a first end of another of one of the first and second conductive wire lengths after the overlap is defined, whereby an end of a said at least one of said first and second conductive wire lengths of a subsequent antenna is indexed into position.

The first wire length is associated with a first desired frequency and the second wire length is associated with a second frequency upon the second wire being coupled to the first wire. The overlap portions of the first and second conductive wire lengths and the insulation therebetween comprising the overlap define both a mechanical and a reactive coupling therebetween.

In one embodiment the overlap portion of the second wire is a loop forming portion that is tightly wrapped around the first wire at a selected location therealong and forming at least one loop such that the remaining or active portion extends beyond an end of the first wire to define an antenna. The at least one loop and the insulation of the at least one wire define a reactive coupling between the first and second wires. The length of the first wire is associated with a first frequency. The reactive coupling and the combined length of the antenna determine the second frequency. The resulting antenna, therefore, can receive and transmit at two frequencies.

The antenna can be tuned to desired frequencies by adjusting the dimensions of the various components of the assembly. It is to be recognized that one or more additional "second wire lengths" may be added to the to the antenna to provide the capability of transmitting and receiving three or more frequencies.

In another embodiment of the invention, both the first and second wire lengths are insulated and are initially affixed together in a co-extending relationship to define a continuous two-wire cable. The method of fabricating the antenna further includes the steps of: severing the first insulated wire length of the continuous cable at locations offset from locations at which the second insulated wire length is severed by a distance equaling the selected distance, whereby the overlap extends between the first end of the second insulated wire length and the second end of the first conductive wire length; and separating the first and second wire lengths axially therealong and therebetween preceding and succeeding the overlap portion.

In another embodiment of the method, the first and second conductive wire lengths initially are defined in a single continuous insulated wire. The method includes the steps of: severing the single continuous insulated wire at first and second locations therealong thereby defining the first and second ends of the second conductive wire length and also defining the first end of the first conductive wire length; moving the second wire length laterally and axially a distance equaling the selected distance for an end length portion thereof to coextend along and adjacent an end length portion of the single continuous insulated wire thereby defining the overlap; mechanically affixing the second wire length to the first wire length at the overlap; and severing the single continuous insulated wire at a distance from the overlap to define the second end of the first conductive wire length.

Embodiments of the invention will now be described by way of example with reference to the accompanying drawings.

DETAILED DESCRIPTION OF EMBODIMENTS OF THE INVENTION

For purposes of illustration, the present invention will be described in terms of a dual band antenna for an electrical article, such as a cellular telephone. The antenna is also suitable for use with paging devices, two-way hand-held and base unit communication devices, GPS units, computer networking systems, transponders and other like devices.

Each of the multiple band antennas made in accordance with the invention have first and second conductive wire lengths that are only partially overlapped a selected distance with at least one of the wire lengths being insulated.

Figure 1:
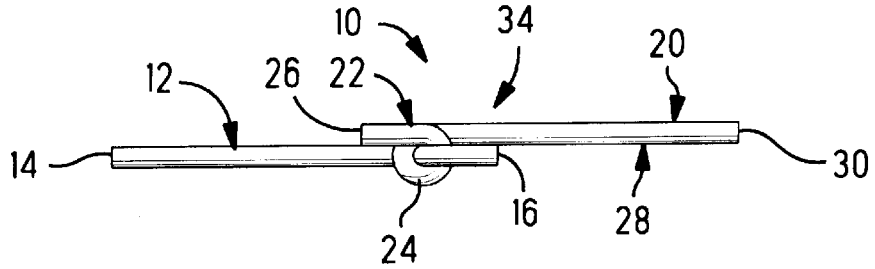
FIG. 1 is a plan view of an antenna made in accordance with the present invention
Figure 2:
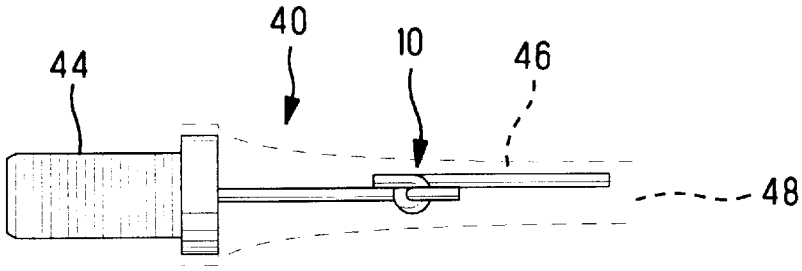
FIG. 2 is a plan view of an antenna assembly including the antenna of FIG. 1, with an outer sheath shown in phantom.

Referring now to FIGS. 1 and 2, a dual band whip antenna 10 includes a first wire 12 and a second wire 20 having the overlap defined by a loop 24 wrapped around the first wire 12. The length of the first wire 12 is associated with a first desired frequency. The first wire 12 has a first end 14 that is adapted for being secured by a screw or other conductive member 44 to an electrical article, such as a cellular telephone (not shown). The second wire 20 includes a loop forming portion 22 extending from a first end 26 and including loop 24 and an active or non-lapped portion 28 extending from the loop 24 to a second end 30. In the assembled antenna, the loop forming portion 22 is tightly wrapped around the first wire 12 forming loop 24 at a selected location such that the active portion 28 extends beyond end 16 of the first wire 12 to define the antenna 10. The length of the active portion 28 when added to a respective first wire length 12 is associated with a second frequency. At least one of the first and second wires 12, 20 is insulated. It is to be understood that both wires 12, 20 may be insulated.

The upper and lower frequencies are defined by the dependent interaction between the wires 12, 20 and the reactive coupling therebetween that occurs in the area of the loop 24 and the overlying wire portions shown generally at 34. The antenna 10 can be tuned by adjusting the dimensions of the wires 12, 20, the amount of insulation on one or both of the wires 12, 20 and the characteristics and number of loops.

In accordance with the invention, a first end of the first wire is adapted to be terminated to an electrical article. In completing an antenna assembly 40, as shown in FIG. 2, the first end 14 of first wire 12 of antenna 10 is terminated to a conductive screw or other member 44 that can be secured to an electrical article. If desired, a non-conductive sleeve or sheath 46 having an end cap 48 may be disposed over antenna 10 and a portion of member 44. Alternatively, a dielectric sleeve can be overmolded on the antenna 10 and portion of member 44 to secure the wires 12, 20 in position and protect the antenna 10 during use. The wires may be copper, stainless steel, titanium or the like, as known in the art. The non-conductive sheath 46 can be made, for example, from polyurethane, vinyl or similar materials.

Figure 3:
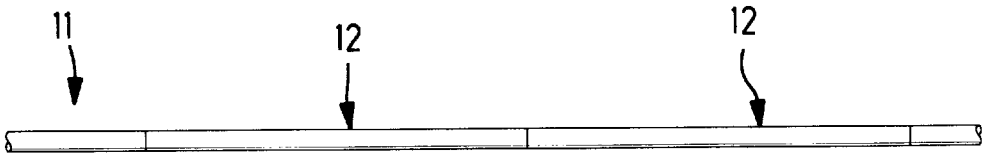
FIG. 3 is a plan view of a portion of a continuous first wire strip used in making the invention of FIG. 1.
Figure 4:
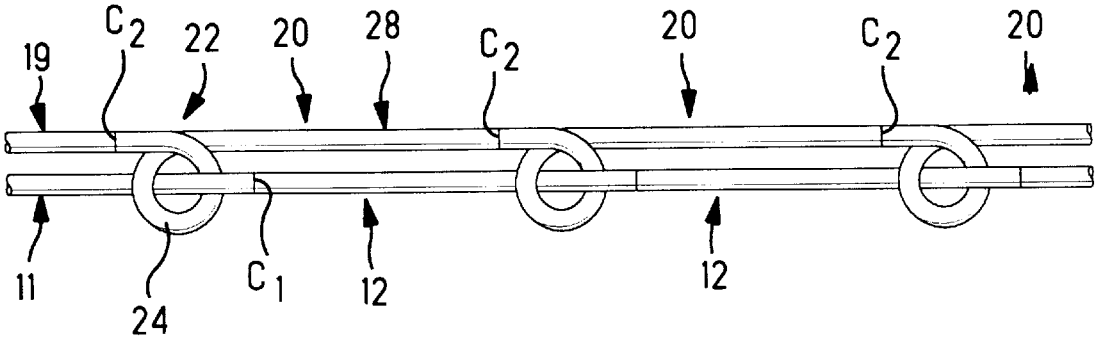
FIG. 4 is a plan view of a portion of a continuous strip of first and second wires used in making the invention of FIG. 1.

The antenna 10 can be made by assembling individual lengths of wire 12, 20. It is more cost effective, however, to assemble the antennas 10 in a continuous manner as illustrated in FIGS. 3 and 4. FIG. 3 shows a continuous strip 11 of a first wire having a plurality of wire lengths 12 associated with a first desired frequency. A second strip 19 of a second wire includes a plurality of second wire portions 20, each having a loop forming portion 22 and an active portion 28 associated therewith. The loop forming portion 22 is wrapped tightly around the first wire 11 at selected locations therealong such that the resultant loops 24 can be tightened against the first wire lengths 12. The first strip of wire 11 is cut into wire lengths 12 by cutting at $C_1$ as indicated in FIG. 4. The second strip 19 of the wire is cut into the second wire sections 20 by cutting at locations $C_2$. By successively cutting each of the two wire strips 11, 19 at $C_1$ and $C_2$, no wire is wasted and a continuous supply of the antennas 10 is thus formed.

Figure 5:
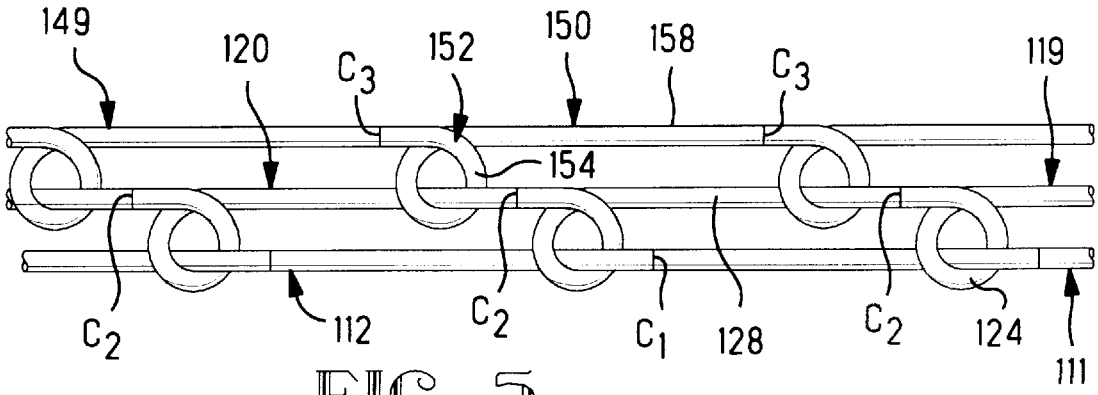
FIG. 5 is plan view of portions of three wire strips used in making another embodiment of a multiple band antenna in accordance with the invention.
Figure 6:
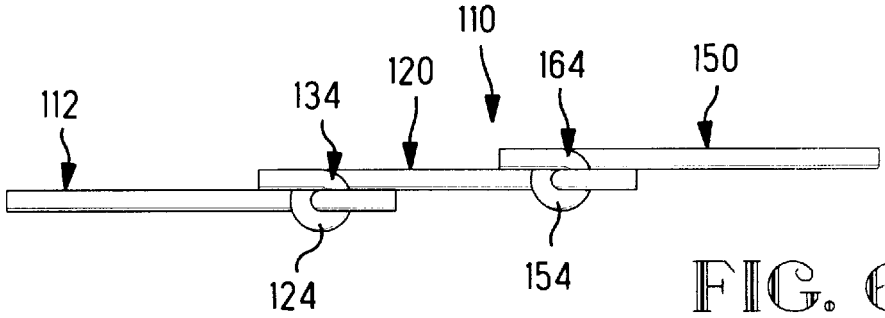
FIG. 6 is a plan view of an antenna made from the wire strips of FIG. 5.

FIGS. 5 and 6 illustrate another antenna embodiment 110 of the present invention in which there are three wire strips 111, 119, and 149. The first wire strip 111 is straight. The second and third wire strips 119 and 149 are each wrapped around another wire strip. The third or "additional second" wire strip 149 includes a plurality of additional loop forming portions 152 and associated additional active portions 158 extending therefrom. The second wire strip 119 is wrapped around the first wire strip 111 forming loops 124 at selected locations, as previously described. The third wire strip 149 is wrapped around the second wire strip 119 in the same manner to form loops 154 at selected locations along the respective active portions 128 of the second wire strip 119. The wire strips 111, 119, and 149 are then cut at $C_1$, $C_2$ and $C_3$, thus creating antenna 110 having three wires 112, 120, and 150, and reactive coupling occurring at 134 and 164, as shown in FIG. 6. In this embodiment, only the second wire strip 119 needs to be insulated to electrically isolate the three wires 112, 120, and 150. Alternatively, the first and third wire strips 111, 149 may be insulated. The antenna of this embodiment can transmit and receive frequencies in three bands. It can be tuned in the same manner previously described. It is to be understood that additional wires and loops may be added to increase the number of frequencies that may be transmitted and received. Additionally one or more of the wires may be wrapped around one or more of the remaining wires to adjust the frequency ranges.

Figure 7:
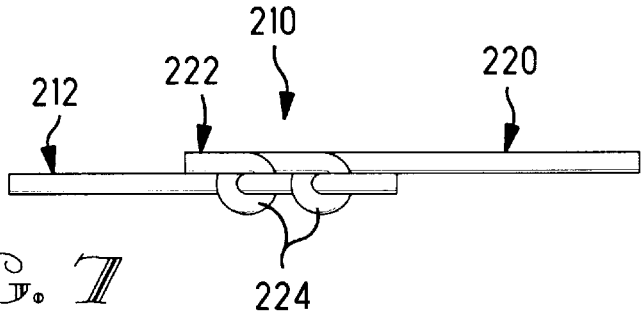
FIG. 7 is a plan view of another embodiment of the antenna.

FIG. 7 illustrates another embodiment 210 of the antenna in which the loop forming portion 222 of the second wire 220 is wrapped around the first wire 212 to form two loops 224 to achieve the desired reactive coupling for tuning the antenna to the desired frequencies.

Figure 8:
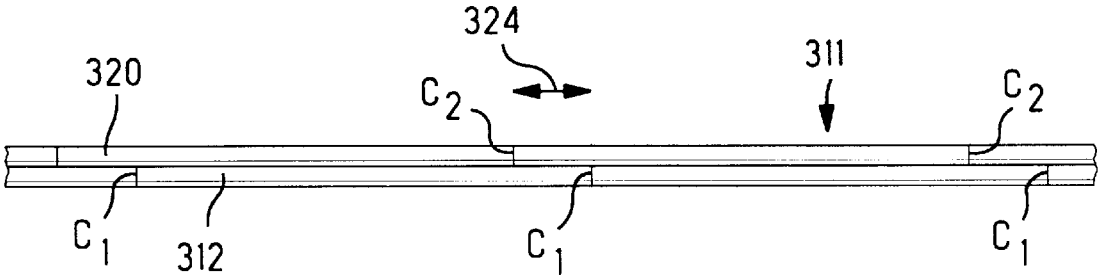
FIG. 8 is a plan view of a portion of a continuous strip of first and second wires used in making another embodiment of the antenna in accordance with the invention.
Figure 9:
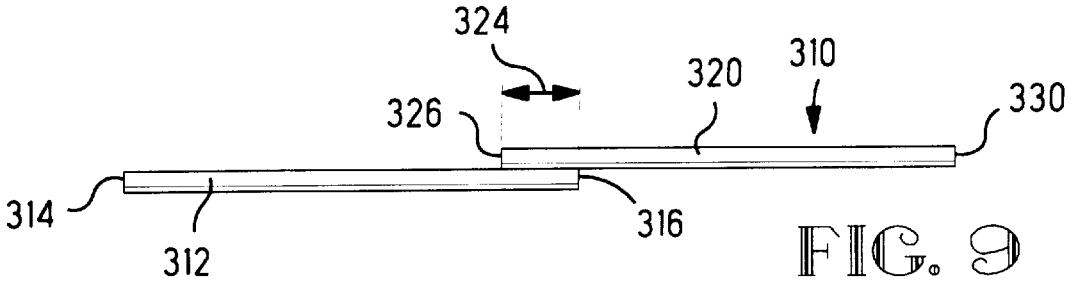
FIG. 9 is a plan view of an antenna made from the wire strip of FIG. 8.

FIGS. 8 through 18 illustrate further embodiments and wire configurations that can be used in accordance with the invention. In FIGS. 8 and 9, the antenna 310 is made from a continuous two wire cable 311 having insulated conductive wire lengths 312, 320 that are initially affixed together in a coextending relationship. The first wire lengths 312 are severed at locations $C_1$ defining first and second ends 314, 316 of first wire length. The second wire lengths 320 are severed at locations $C_2$ defining first and second ends 326, 330 of second wire length 320. Locations $C_2$ are offset from that of $C_1$ by a distance equaling the selected overlap 324. The overlap 324 extends between the first end 326 of the second wire length 320 and the second end 316 of the first wire length. The first and second wire lengths 312, 320 are separated axially therealong and therebetween preceding and succeeding the overlap portion 324. The two wire cable 311 may be made by extruding insulation around the two wires.

Figure 10:
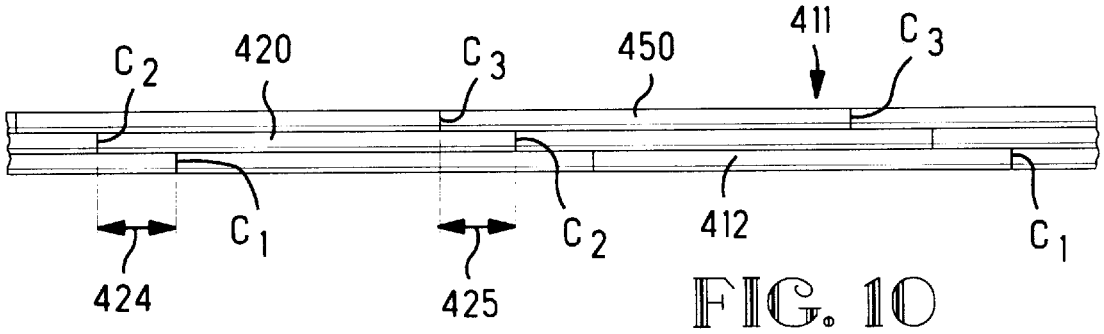
FIG. 10 is plan view of portions of three wire strips used in making another embodiment of a multiple band antenna in accordance with the invention.
Figure 11:
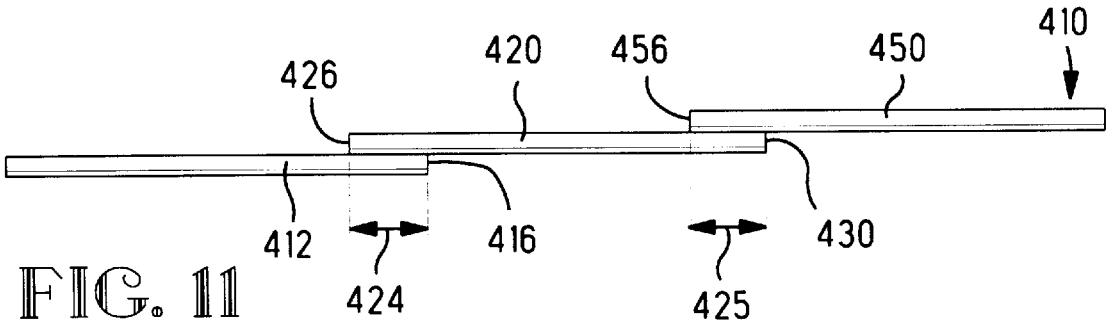
FIG. 11 is a plan view of an antenna made from the wire strips of FIG. 10.

FIGS. 10 and 11 define another antenna embodiment 410 similar to the one described above in which there are three wire lengths 412, 420 and 450 in a cable 411. The respective wires are severed at locations $C_1$, $C_2$, and $C_3$ and the respective wires are separated axially therealong as described above to define the overlaps 424 and 425 of the antenna shown in FIG. 11. Overlap 424 extends between second end 416 of first wire 412 and first end 426 of second wire 420. Overlap 425 extends between second end 430 of second wire 420 and first end 456 of third wire 450.

Figure 12:
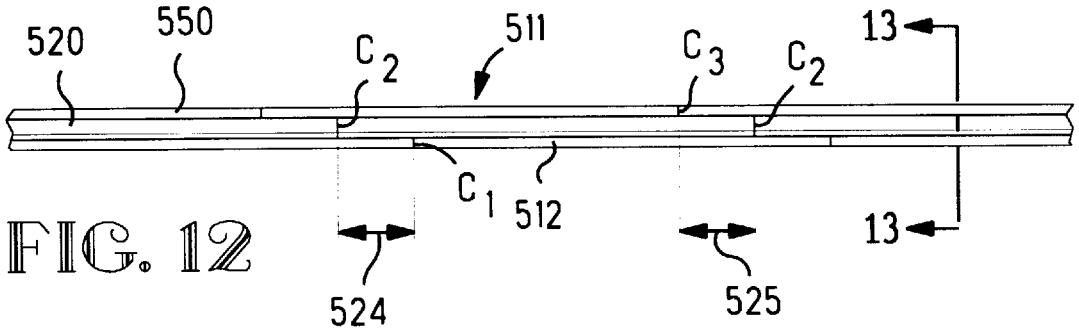
FIG. 12 is plan view of portions of three wire strips used in making a further embodiment of a multiple band antenna in accordance with the invention.
Figure 13:
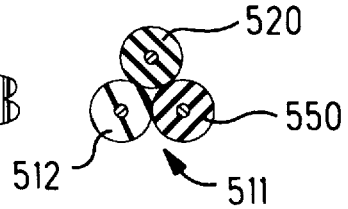
FIG. 13 is a sectional view taken along line 13—13 of FIG. 12.

FIGS. 12 and 13 illustrate wire or cable configuration 511 including three wires 512, 520 and 550 that are arranged in a triangular arrangement. The wires are severed at locations $C_1$, $C_2$, and $C_3$ and the respective wires are separated axially therealong as described above to define the overlaps 524 and 525.

Figure 14:
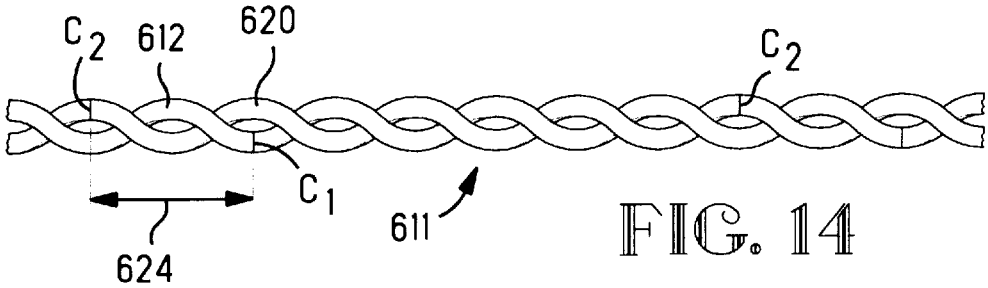
FIG. 14 is a plan view of a portion of a continuous strip of first and second wires used in making another embodiment of the invention.

FIG. 14 illustrates wire configuration 611 formed from a twisted pair of wires 612 and 620 that are severed at severed at locations $C_1$ and $C_2$ to define the overlap 624.

Figure 15:
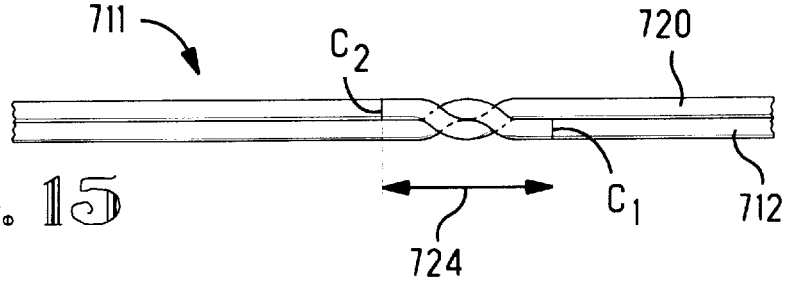
FIG. 15 is a plan view of a portion of a continuous strip of first and second wires used in making another embodiment of the invention.

FIG. 15 illustrates wire configuration 711 in which two wires 712, 720 are twisted at preselected intervals to define an overlap 724. The wires are severed at locations $C_1$ and $C_2$ to define the overlap 724.

Figure 16:
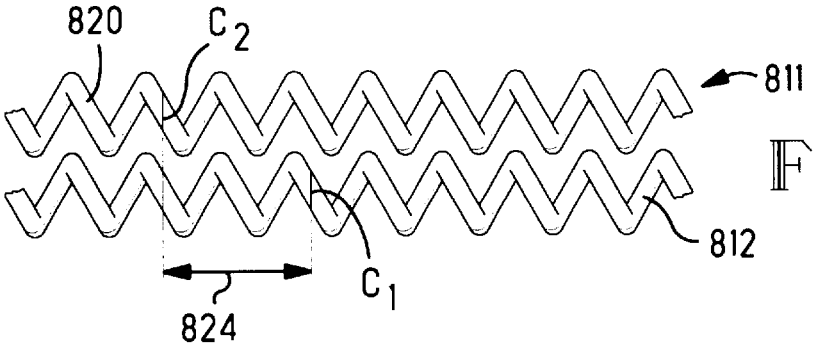
FIG. 16 is a plan view of a portion of a continuous strip of first and second coiled wires used in making another embodiment of the invention.

FIG. 16 discloses wire configuration 811 in which a two wire cable is formed from coiled spring wires 812, 820, which are severed at $C_1$ and $C_2$ to define the overlap 824. The antenna is separated in the same manner as that of embodiment 310.

Figure 17:
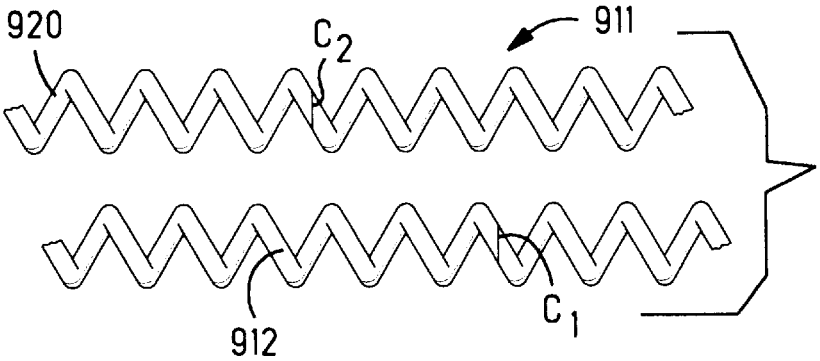
FIG. 17 is a plan view of a portion of a continuous strip of first and second coiled wires used in making a further embodiment of the invention.
Figure 18:
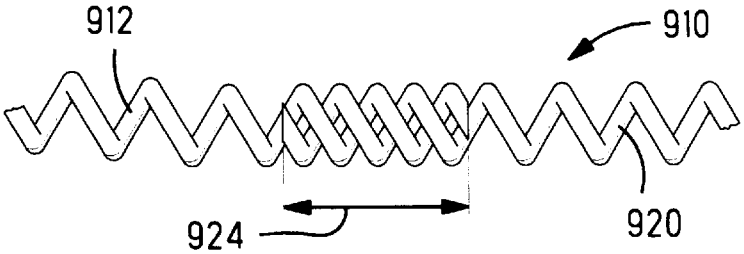
FIG. 18 is a plan view of an antenna made from the wire strips of FIG. 17.

FIGS. 17 and 18 illustrate antenna embodiment 910 in which two individual insulated coiled spring wires 911 are cut into the desired lengths 912, 920 and a portion of the coils of the first wire length 912 are overlapped and interleaved into a portion of the coils of the second wire length 920 to define overlap 924. It is to be understood that both wire lengths 912, 920 may be cut one wire 911.

The present invention provides a multiple band whip antenna that is compact, easily tunable and cost effective to manufacture. The antennas can be made in a continuous manner that substantially eliminates any wasted materials. It is to be understood the antenna of the present invention is suitable for use with devices using other frequencies and that additional wires may be added to provide an antenna that may transmit and receive multiple frequencies.

It is thought that the antenna of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. A continuous method of fabricating multiple band antennas in sequence each having at least first and second conductive wire lengths that are only partially overlapped a selected distance, at least one of said wire lengths being insulated, comprising the steps of:

severing a first end of at least one of said first and second conductive wire lengths from a second end of a preceding antenna;

defining an overlap portion of said first conductive wire length coextending a selected distance along and adjacent an overlap portion of said second conductive wire length, said overlap portions of said first and second conductive wire lengths and the insulation therebetween comprising an overlap and defining both a mechanical and a reactive coupling therebetween; and severing said second end of at least one of said first and second conductive wire lengths from a first end of another of said one of said first and second conductive wire lengths of a subsequent antenna after said overlap is defined, thereby defining an antenna, whereby an end of said at least one of said first and second conductive wire lengths of the subsequent antenna is indexed into position.

2. The method of claim 1 further comprising the step of terminating an end of said antenna to an electrical article.

3. The method of claim 2 further comprising the step of disposing insulating material around said first and second wires and overlap to secure said wires in position.

4. The method of claim 1 further comprising the step of disposing insulating material around said first and second wires and overlap to secure said wires in position.

5. The method of claim 1 wherein said overlap is formed by wrapping the overlap portion of one of said wire lengths around the overlap portion of the other of said wire lengths to form a first loop in the overlap portion of said one of said wire lengths.

6. The method of claim 5 further comprising the step of forming at least a second loop in said overlap portion of said one of said wire lengths and wrapping said second loop around said overlap portion of the other of said wire lengths.

7. The method of claim 6 further comprising the step of terminating an end of said antenna to an electrical article.

8. The method of claim 7 further comprising the step of disposing insulating material around said first and second wires and said first loop and said second loop to secure said wires in position.

9. The method of claim 6 further comprising the step of disposing insulating material around said first and second wires and said first loop and said second loop to secure said wires in position.

10. An antenna made in accordance with claim 5.

11. The method of claim 1 further including the steps of:

providing at least one additional second conductive wire length having an additional overlap portion wherein said first wire length, and said second wire length and said additional second conductive wire length have a combined length;

defining an additional overlap between said overlap portion of said second conductive wire length and said additional overlap portion, at least one of said second and additional second wire length being insulated, said additional overlap and said insulation therebetween defining both an additional mechanical and an additional reactive coupling therebetween; and severing said second wire length on one side of said additional overlap and said additional wire length on another side of said additional overlap such that said additional wire length extends outwardly from said second conductive length in a direction opposite to said first wire length, said additional reactive coupling and said combined length of said antenna determining a frequency for said antenna.

12. The method of claim 11 further comprising the step of terminating an end of said antenna to an electrical article.

13. The method of claim 12 further comprising the step of disposing insulating material around said first, second and additional second wires and said overlap and additional overlap to secure said wires in position.

14. The method of claim 11 further comprising the step of disposing insulating material around said first, second and additional second wires and said overlap and additional overlap to secure said wires in position.

15. The method of claim 11 wherein said overlap portion of one of said wire lengths around the overlap portion of one of the other of said wire lengths and the additional overlap portion of said additional second wire length is wrapped around another overlap portion of one of said wire lengths.

16. The method set forth in claim 1 wherein both said first and second wire lengths are insulated and are initially affixed together in an extending relationship to define a continuous two-wire cable, further comprising the steps of:

severing said continuous first insulated wire at locations offset from locations at which said continuous second insulated wire is severed by a distance equaling said selected distance, whereby said overlap extends between said first end of said second insulated wire length and said second end of said first conductive wire length; and separating said first and second wire lengths axially therealong and therebetween preceding and succeeding said overlap portion.

17. An antenna made in accordance with claim 16.

18. The antenna of claim 17 wherein said wire lengths are coiled wires.

19. The method as set forth in claim 1 wherein said first conductive wire length and said second conductive wire length initially are defined in a single continuous insulated wire, comprising the steps of:

severing said single continuous insulated wire at first and second locations therealong thereby defining said first and second ends of said second conductive wire length and also defining said first end of said first conductive wire length;

moving said second wire length laterally and axially a distance equaling said selected distance for an end length portion thereof to coextend along and adjacent an end length portion of said single continuous insulated wire thereby defining said overlap;

mechanically affixing said second wire length to said first wire length at said overlap; and severing said single continuous insulated wire at a distance from said overlap to define said second end of said first conductive wire length.

20. An antenna made in accordance with claim 19.

21. The antenna of claim 20 wherein said wire lengths are coiled wires.

22. The antenna made in accordance with claim 1 wherein said wire lengths are coiled wires.

23. A multiple band antenna comprising:

a selected length of a first wire having an overlap portion, said length being associated with a first desired frequency; and a selected length of at least a second wire having an overlap portion, and further having an active portion extending from said overlap portion and being associated with a second frequency upon said second wire length being coupled to said first wire length, at least one of said first and second wire lengths being insulated;

said overlap portion of said first wire length coextending a selected distance along and adjacent said overlap portion of said second wire length, said overlap portions and the insulation therebetween comprising an overlap and defining both a mechanical and a reactive coupling therebetween to define an antenna having a combined length, said reactive coupling and said combined length of said antenna, determining the second frequency.

24. The antenna of claim 23 wherein said wire lengths are coiled wires.

25. The antenna of claim 23 wherein an end of said antenna is terminated to an electrical article.

* * * * *